United States Patent [19]

Vola

[11] 4,068,622

[45] Jan. 17, 1978

[54] MAGNETIC ROLLER

[75] Inventor: Mathias J. J. M. Vola, Sittard, Netherlands

[73] Assignee: Oce-van der Grinten N.V., Venlo, Netherlands

[21] Appl. No.: 733,127

[22] Filed: Oct. 18, 1976

[30] Foreign Application Priority Data

Oct. 22, 1975 Netherlands ..... 7512356

[51] Int. Cl.[2] ..... B05B 5/02

[52] U.S. Cl. ..... 118/658

[58] Field of Search ..... 118/657, 658; 29/132; 355/3 R, 3 DD

[56] References Cited

U.S. PATENT DOCUMENTS

| | | | |
|---|---|---|---|
| 3,152,924 | 10/1964 | Wawielista et al. | 118/657 |
| 3,392,432 | 7/1968 | Naumann | 118/657 |
| 3,437,074 | 4/1969 | Hagopian | 118/658 |
| 3,455,276 | 7/1969 | Anderson | 118/658 |
| 3,552,355 | 1/1971 | Flint | 118/657 |
| 3,879,737 | 4/1975 | Lunde | 118/657 |

FOREIGN PATENT DOCUMENTS

| | | | |
|---|---|---|---|
| 2,224,624 | 11/1972 | Germany | 355/3 DD |

*Primary Examiner*—Ronald Feldbaum
*Attorney, Agent, or Firm*—Albert C. Johnston; Gerard R. Dunne

[57] ABSTRACT

A magnetic roller comprising a diamagnetic cylinder rotatable about magnetic poles which extend axially inside the cylinder and are each formed by similar poles of magnets lying axially beside each other is made to generate a substantially homogeneous magnetic field over its full working width, thus enabling the magnets to be made of strongly ferromagnetic, anisotropic material, by the provision, over and along one or more of the magnetic poles between the magnetic pole and the diamagnetic cylinder, of a material having high magnetic permeability, such as a strip of soft iron of between 0.1 and 1 mm. in thickness fixed to and not wider than the surface of the magnetic pole. The magnetic roller is especially useful in electrophotographic developing apparatus for transporting magnetically attractable developing powder between a powder reservoir and a developing zone in which powder from a magnetic brush formed on the cylinder is applied to electrostatic images on imagewise exposed photoconductive sheet material.

11 Claims, 2 Drawing Figures

MAGNETIC ROLLER

Figure 1:
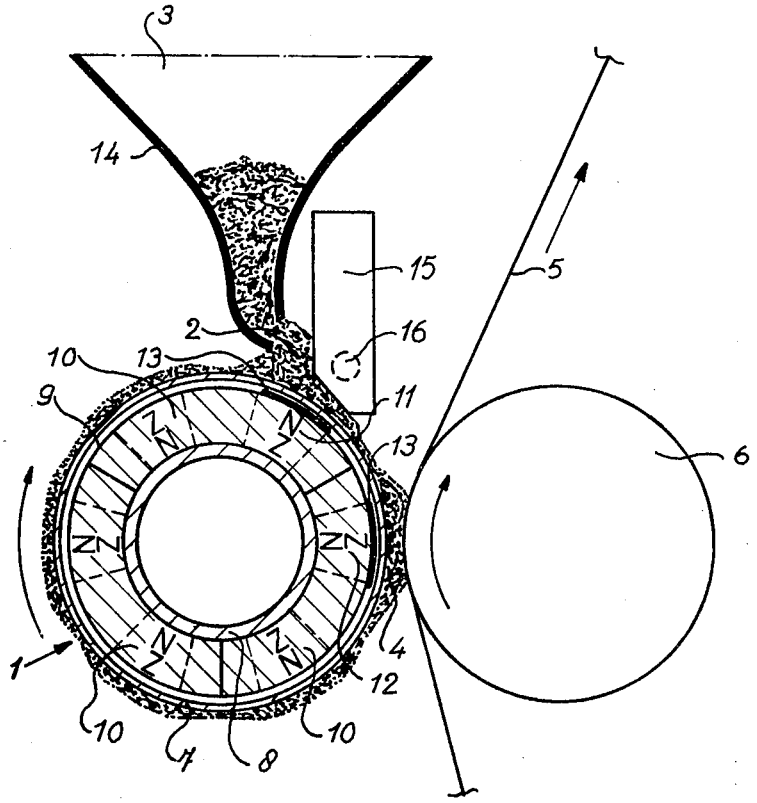

This invention relates to a magnetic roller comprising a rotatable cylinder of a diamagnetic material and magnetic poles which extend in axial direction inside of the cylinder and are each formed by similar poles of magnets lying axially beside each other. The invention also relates to an electrophotographic developing apparatus comprising such a magnetic roller.

The development of latent electrostatic images is often effected in so-called magnetic brush developing devices, in which a magnetically attractable developing power is supplied to the latent electrostatic images from a powder reservoir by means of one or more magnetic rollers. As explained in British patent specification No. 1,216,915, in order to obtain a uniform development of the electrostatic image it is necessary to have a uniform powder layer present, at least in the developing zone, on the magnetic roller supplying the developing powder to the image. A uniform powder layer can be obtained only when a homogeneous magnetic field is present in the developing zone over the whole working width of the magnetic roller. Further it is necessary, particularly in quickly working developing devices, that a strong magnetic field be generated near the cylinder surface of the magnetic roller to prevent the developing powder from being flung away at high rotational speeds of the cylinder. In developing devices in which an electrostatic image is developed with electrically conductive, magnetically attractable developing powder, a strong magnetic field is also necessary in order to prevent developing powder from depositing on residual charges present in the background areas of the image carrying surface.

For generating strong magnetic fields various permanently magnetic materials are known. Special examples are ceramic magnets composed of sintered ferrite particles all having the same orientation perpendicular or almost perpendicular to the axis of the magnet. However, since the ferrite particles have the same orientation, these strongly magnetizable materials are strongly anisotropic; so only short magnets having a length of at most 10–15 cm can be made of them. Consequently, when employing such magnets in a magnetic roller it is necessary to place a number of short magnets axially beside each other in order to obtain the required working width. Then, in order to produce a homogeneous magnetic field over the whole working width of the roller, the magnets must be placed closely against each other. This, however, is also almost impossible, because the anisotropic materials are so brittle that it is very difficult to polish them completely flat, and they can break off easily at the edges.

The present invention provides an improved magnetic roller by which a homogeneous magnetic field is generated, while using short magnets lying axially beside each other.

The improved magnetic roller according to the invention comprises a rotatable cylinder of diamagnetic material and magnetic poles which extend in axial direction inside the cylinder and are each formed by similar poles of a number of magnets lying axially beside each other, and is characterized in that a material having a high magnetic permeability is installed over and along at least one of the axially extending magnetic poles between the magnetic pole and the diamagnetic cylinder.

By providing a material having high magnetic permeability between the diamagnetic cylinder and the axially extending magnetic pole formed by similar poles of magnets lying axially beside each other, the discontinuities in the magnetic field in the transition area of each pair of magnets lying beside each other are almost completely eliminated, and in this way a sufficiently homogeneous magnetic field is generated at the surface of the diamagnetic cylinder, over the full working width of the cylinder.

According to a preferred embodiment of the invention a strip of ferromagnetic material the width of which does not exceed that of the magnetic pole itself is fixed over at least one magnetic pole extending in axial direction.

Figure 2:
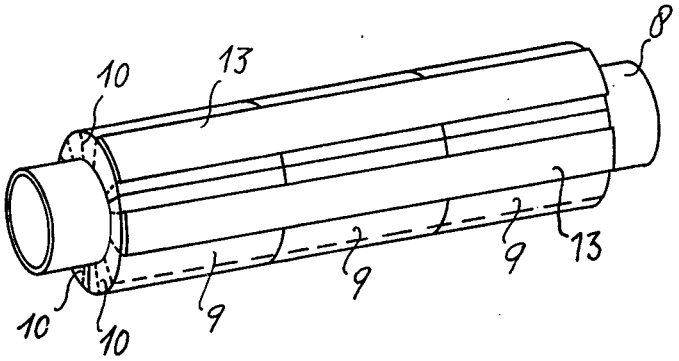

The invention will now be further explained in the following description, in which reference is made to the accompanying drawing. In the drawing:

FIG. 1 is a schematic sectional view of an apparatus for the development of electrostatic images, in which a magnetic roller according to the invention is employed, and FIG. 2 is a perspective view of the magnet core of the magnetic roller according to the invention.

The developing apparatus illustrated in the drawing comprises a magnetic roller 1 according to the invention, onto which roller magnetically attractable developing powder is transferred from a powder reservoir 3 via the opening 2 at the bottom of the reservoir. The magnetic roller 1 transports the developing powder to a developing zone 4 where the powder is brought into contact with the image forming surface of a sheet- or belt-like photoconductive material 5, which material is conveyed over a support roller 6 and bears a latent electrostatic charge image at its side facing the powder layer. After the development the developing powder that is not transferred to the electrostatic charge image is returned back into the powder supply zone on the magnetic roller 1. The magnetic roller 1 according to the invention comprises a cylinder 7 of diamagnetic material, such for instance as aluminum, brass or stainless steel, which cylinder is mounted rotatably on a shaft 8 via bearings, and which, when the apparatus is operating, is driven in the direction indicated by the arrow by known drive means (not shown). The shaft 8 of the magnetic roller is firmly fixed in a frame plate of the apparatus, which frame plate is not illustrated.

On the shaft 8, which is made of a material having high magnetic permeability, for instance of soft iron, cylindrical magnets 9 are mounted beside each other (see FIG. 2). Each of these magnets is built up of a number of identical cylinder segments 10, for instance three, which have been magnetized more than once, for instance two times, in radial direction. The magnets 9 are placed about the shaft in such manner that their similar poles are aligned with one another and thus together form one magnetic pole extending in axial direction.

The outer diameter of the cylindrical magnets 9 is smaller than the inner diameter of the diamagnetic cylinder 7. In the space between these diameters strips 13 composed of a material having high magnetic permeability, for instance of soft iron, are fixed over a number of the axially extending magnetic poles, for instance over the two magnetic poles 11 and 12 which are located along the path of the powder supply zone up to and including the developing zone 4. The material of the strips 13 should in any case be a ferromagnetic material having a magnetic permeability at least as great as that of iron. The length of the strips 13 is at least equal to the required working width of the magnetic roller, while the width of each strip does not exceed that of the magnetic pole to which it is fixed. In order to prevent shorting of the magnetic field, neighboring strips 13 may in no case touch each other. The thickness of the strips 13 lies between 0.1 and 1 mm and preferably amounts to about 0.5 mm.

By providing the strips having high magnetic permeability over the axially extending magnetic poles according to the invention, the discontinuities existing in the magnetic field in the region of transition from one to another of the magnets 9 are eliminated at least for the greater part, and a substantially homogeneous magnetic field is obtained at the overlying outer surface of the diamagnetic cylinder 7. Thus the invention makes it possible to generate a homogeneous strongly magnetic field over a large working width by means of strong magnets which up to now could not be used in magnetic rollers because they could not be manufactured in the required lengths. For instance, the invention makes it possible to generate homogeneous magnetic fiels having a magnetic flux of 800–1200 Gauss at the cylinder surface by installing beside each other on the shaft 8 short magnets having a flux of 1200–1800 Gauss at the poles. Such strong magnets may for instance be made of anisotropic radially predirected sintered ferrite which is commercially available under the name "Ferroxdure 330 rad." Magnets made of this material can be obtained in lengths up to about 5 cm.

The magnetically attractable developing powder is transferred onto the cylinder 7 of the magnetic roller via the opening 2 of the reservior 3, the side plate 14 of which is shaped according to an exponential curve in order to improve the ejection of the developing powder. The reservoir opening 2 extends in axial direction over approximately three-fourths ($\frac{3}{4}$) of the cylinder length and is situated centrally above the cylinder 7. Near the opening 2 a scraper 15 is provided which extends in axial direction over the whole cylinder length and distributes the supplied developing powder into a uniform layer over the whole working width of the cylinder 7. The two extremities of the scraper 15 are provided with shaft journals 16 which are fixed in the frame plates of the apparatus but which can be turned and reset to adjust the distance between the scraper 15 and the cylinder 7 and thus control the thickness of the powder layer transferred onto the cylinder. The uniformity of this powder layer is not disturbed while it is being transported by the cylinder 7 to the developing zone 4, thanks to the presence of an almost homogeneous magnetic field at the cylinder surface.

The developing powder entering the magnetic field in the developing zone 4 between the magnetic pole 12 and the support roll 6, which magnetic field is homogeneous in axial direction, is directed into a uniform developing brush and is thus brought into contact with the electrostatic image to be developed. The developing powder that is not transferred to the electrostatic image continues to be held against the cylinder by the remaining magnets, and is thus returned again into the powder supply zone by the cylinder 7.

The illustrative embodiment of the invention, as described above, can be varied in numerous ways. Of course strips of material having high magnetic permeability can be provided over all the magnetic poles extending in axial direction at the inside of the cylinder 7. Generally, however, such strips will only be installed over those magnetic poles which, for good operation of the magnetic roller, should generate a homogeneous magnetic field at the cylinder surface. When employing the magnetic roller as a developing roller in an eletrophotographic developing apparatus, these magnetic poles are the one or more poles which are situated in the developing zone or, preferably, in the path from the powder supply zone up to and including the developing zone.

For the formation of the axially extending magnetic poles it is of course also possible to place magnet bars axially beside each other on the shaft 8, instead of cylindric magnets. Instead of being fixed on the magnetic poles the strips of the material having high magnetic permeability can also be provided in or on a tube of diamagnetic material. In such a case the tube is slid between the axially extending magnetic poles and the diamagnetic cylinder 7 and is then fixed to the magnets or to the shaft 8 so that the strips of magnetically permeable material are situated exactly over the magnetic poles.

What is claimed is:

1. In a magnetic roller comprising a rotatable cylinder of diamagnetic material and magnetic poles extending in axial direction inside said cylinder, each of said magnetic poles being formed by respective pole portions of like polarity of a plurality of magnets, which pole portions lie beside one another axially of the cylinder, the improvement which comprises at least one of said magnetic poles having disposed over and along said pole portions thereof between the same and said cylinder a length of material having high magnetic permeability, whereby a substantially homogeneous magnetic field is maintained over the length of the magnetic pole.

2. Magnetic roller according to claim 1, said material having high magnetic permeability being a ferromagnetic material.

3. Magnetic roller according to claim 1, said material having high magnetic permeability being in the form of a strip fixed to the surface of the magnetic pole.

4. Magnetic roller according to claim 1, said material having high magnetic permeability being in the form of a strip of soft iron fixed to the surface of the magnetic pole, the thickness of said strip being between 0.1 and 1 mm. and its width being not greater than the width of said surface.

5. Magnetic roller according to claim 1, said magnets each being composed of strongly ferromagnetic, anisotropic ferrite particles oriented radially relative to the axis of said cylinder.

6. Magnetic roller according to claim 4, said magnets each being composed of strongly ferromagnetic, anisotropic ferrite particles oriented radially relative to the axis of said cylinder.

7. Apparatus for developing latent electrostatic images, comprising a reservoir for developing powder and means including at least one magnetic roller according to claim 1 for supplying developing powder from said reservoir to each electrostatic image.

8. Apparatus for developing latent electrostatic images, comprising a reservoir for developing powder and means including at least one magnetic roller according to claim 4 for supplying developing powder from said reservoir to each electrostatic image.

9. Apparatus for developing latent electrostatic images, comprising a reservoir for developing powder and means including at least one magnetic roller according to claim 6 for supplying developing powder from said reservoir to each electrostatic image.

10. In a magnetic roller comprising a diamagnetic cylinder rotatable about a magnet assembly formed of a plurality of arcuate magnet segments arranged side by side about and along a common axis, each of said segments being magnetized radially in circumferentially spaced regions thereof to present axially along the segment at its outer surface circumferentially spaced pole portions of opposite polarity, the respective pole portions of like polarity of the axially aligned segments lying in alignment to form respective magnetic poles axially along the cylinder; the improvement which comprises each of at least one of said magnetic poles having a strip of soft iron disposed along it and over the respective magnet segments which form it, between the latter and said cylinder, for forming a substantially homogeneous magnetic field outside said cylinder over the length of the magnetic pole.

11. In an apparatus for developing latent electrostatic images, comprising a reservoir for magnetically attractable powder suitable for developing said images and means including a magnetic roller for bringing powder from said reservoir into contact with said images in a developing zone spaced from said reservoir, said roller comprising a diamagnetic cylinder rotatable about a magnet assembly formed of a plurality of arcuate magnet segments arranged side by side about and along a common axis, each of said segments being magnetized radially in circumferentially spaced regions thereof to present axially along the segment at its outer surface circumferentially spaced pole portions of opposite polarity, the respective pole portions of like polarity of the axially aligned segments lying in alignment to form respective magnetic poles axially along the cylinder; the improvement which comprises each of at least one of said magnetic poles having a strip of soft iron disposed along it and over the respective magnet segments which form it, between the latter and said cylinder, for forming a substantially homogeneous magnetic field outside said cylinder over the length of the magnetic pole.

* * * * *